US012114817B2

(12) United States Patent
Mathur

(10) Patent No.: US 12,114,817 B2
(45) Date of Patent: Oct. 15, 2024

(54) TOILET SEAT WARMER AND METHOD

(71) Applicant: NUVUM LLC, Cupertino, CA (US)

(72) Inventor: Anant Mathur, Cupertino, CA (US)

(73) Assignee: NUVUM LLC, Cupertino, CA (US)

( * ) Notice: Subject to any disclaimer, the term of this patent is extended or adjusted under 35 U.S.C. 154(b) by 0 days.

(21) Appl. No.: 17/459,787

(22) Filed: Aug. 27, 2021

(65) Prior Publication Data

US 2023/0062329 A1 Mar. 2, 2023

(51) Int. Cl.
*A47K 13/30* (2006.01)

(52) U.S. Cl.
CPC ..... *A47K 13/305* (2013.01)

(58) Field of Classification Search
CPC ..... A47K 13/305
See application file for complete search history.

(56) References Cited

U.S. PATENT DOCUMENTS

| | | | | |
|---|---|---|---|---|
| 2010/0095443 | A1* | 4/2010 | Nishimura | A47K 13/305 219/217 |
| 2016/0235263 | A1* | 8/2016 | Du | H05B 3/00 |
| 2018/0049607 | A1* | 2/2018 | Takeshita | A47K 13/04 |

FOREIGN PATENT DOCUMENTS

| | | | |
|---|---|---|---|
| CN | 110623584 | * | 12/2019 |
| CN | 111150321 | * | 2/2020 |
| CN | 111155618 | * | 5/2020 |
| KR | 20120043484 | * | 5/2012 |
| WO | WO-9511615 A1 | * | 5/1995 |
| WO | WO-2007040279 A1 | * | 4/2007 |

* cited by examiner

*Primary Examiner* — J C Jacyna
(74) *Attorney, Agent, or Firm* — The Rapacke Law Group, P.A.; Andrew S. Rapacke

(57) ABSTRACT

A seat warming device and method suitable for toilet seats is provided. The device includes two or more leaves connected to a control unit. Each leaf includes a soft layer surrounding a compressible layer with a heating element embedded in the compressible layer and a temperature sensor. In some configurations, each leaf includes a soft layer that is textured and anti-microbial, a compressible layer under the soft layer with a heating element embedded in the compressible layer, a substrate layer under the compressible layer, a pressure sensor configured to send an activation signal based on a threshold pressure, a biosensor configured to send a bio-signal, and a temperature sensor that sends a temperature signal. The control unit activates the heating element based on the activation signal. A remote control is configured to send a desired temperature to adjust the heating element temperature.

4 Claims, 5 Drawing Sheets

TOILET SEAT WARMER AND METHOD

FIELD

The present disclosure relates to a layered warming device and method that can change the temperature and warmth of a seat, including a toilet seat, by placing the warming device on the seat and a user manually controlling the temperature of the warming device or the warming device automatically adjusting the temperature and sensing when the user seats on the warming device.

BACKGROUND

Typically, chairs and seats, including toilet seats, operate at ambient temperature. Depending on the ambient temperature, the material with which the seat is made, and the mode of use of the seat, the use of the seat by a person will be more or less comfortable. Generally, when a person is using a toilet seat, the mode of use will be the bare skin of the person on the toilet seat and the ambient temperature will be cold, causing the toilet seat to be cold. Bare skin on a cold toilet seat will cause an immediate uncomfortable cold sensation to the person. This uncomfortable cold sensation will generally occur regardless of the material with which the seat is made, whether the material is plastic, resin, polyresin, porcelain, etc.

Existing devices for warming toilet seats include a heating element integrated inside the toilet seat itself, requiring initial manufacturing of the toilet seat with the heating element or replacement and installation of a toilet seat with a new toilet seat with the heating element inside. Thus, this type of warming toilet seat requires time and results in higher costs due to the required replacement and installation. Furthermore, different toilets will require different warming toilet seat structures for appropriate installation.

Other existing devices for warming toilet seats include a heating element enclosed between a top layer and a bottom layer. These devices operate by being placed on top of the toilet seat. These devices are manufactured to a particular size and shape, causing difficulty or inoperability on toilet seats of different shapes and sizes. Furthermore, these devices require manual operation after the user has seated on the device, resulting in a delay between the moment the user sits and the moment the device starts to warm up.

Yet other existing devices for warming toilet seats include pads and covers for toilet seats. These pads and covers lack active heating. The typical design for pads and covers involves the pad or cover wrapping around the surface of the toilet seat, potentially creating poor hygienic conditions.

Without the necessary technology for flexible modular seat warmers, a seat warmer that be fitted to any existing toilet seats is not possible. For the foregoing reasons, there is a need for a toilet seat warmer that can be installed on any seat, regardless of shape or size, without requiring timely and costly installations, and that provides users with various operation modes and methods to activate and control the warmth and temperature of the warming device, including automatic warming upon sitting.

SUMMARY

In various embodiments, a seat warming device and method suitable for heating a toilet seat and other types of seats is provided. The device includes two or more leaves connected to a control unit and a first temperature sensor embedded in a first leaf of the two or more leaves, with each of the two or more leaves including a soft layer surrounding a compressible layer and a heating element. In some embodiments, each of the two or more leaves includes a soft layer, a compressible layer under the soft layer, a heating element, and a substrate layer under the compressible layer. In some embodiments, each of the two or more leaves includes a soft layer that is textured and anti-microbial, a compressible layer under the soft layer, a heating element embedded in the compressible layer, a substrate layer under the compressible layer, the substrate layer comprising an adhesive side capable of bonding to a seat surface or a toilet seat surface, and a pressure sensor configured to send an activation signal to the control unit based on a threshold pressure, wherein at least one of the two or more leaves further comprises a bio-sensor configured to send a bio-signal to the control unit.

In some embodiments, the control unit is configured to activate the heating element based on the activation signal. In some embodiments, the control unit adjusts the temperature of the heating element based on a measurement by the temperature sensor. In some embodiments, the length of the cables connecting the control unit to the leaves is adjustable. In some embodiments, the control unit and/or the leaves are wireless. The cable adjustability and/or the wireless operation between the control unit and the leaves allows for the seat warming device to be modified to adequately fit a wide range of seat shapes and designs, including a wide range of toilet seat shapes and designs.

In some embodiments, at least one of the two or more leaves includes a pressure sensor. In some embodiments, each of the two or more leaves includes a pressure sensor. In some embodiments, at least one of the two or more leaves further comprises a pressure sensor configured to send an activation signal to the control unit.

In some embodiments, the first temperature sensor is embedded in the compressible layer of the first leaf, while in other embodiments the first temperature sensor is embedded in the soft layer, the substrate layer, under, over, or around at least one of the two or more leaves. In some embodiments, two or more temperature sensors are located at or embedded in different parts or portions of different leaves, or embedded in or between different layers of different leaves. The temperature sensors may measure ambient temperature, a temperature of a surface of the soft layer, a temperature of the heating element, a temperature of a leaf, a temperature of a layer of a leaf, a temperature of a user sitting on or touching the leaf, or a combination of such temperatures. In some embodiments, the device comprises a second temperature sensor embedded in a second leaf of the two or more leaves, wherein the first temperature sensor measures a temperature of a surface of the soft layer of the first leaf and the second temperature sensor measures one of the group comprising ambient temperature, a temperature of the heating element of the second leaf, and a temperature of a user of the seat warming device.

In some embodiments, the soft layer is textured, anti-microbial, or both textured and anti-microbial. In some embodiments, the surface of the soft layer is textured, anti-microbial, or both textured and anti-microbial.

In some embodiments, at least one of the two or more leaves further comprises a biosensor configured to send a bio-signal signal to the control unit. In some embodiments, the control unit is configured to activate the heating element based on the activation signal and the bio-signal. In some embodiments, the control unit adjusts the temperature of the heating element based on a measurement by the first temperature sensor. In some embodiments, the control unit adjusts the temperature of the heating element based on a measurement by the first temperature sensor and the bio-signal. In some embodiments, the device comprises a second temperature sensor embedded in a second leaf of the two or more leaves, wherein the first temperature sensor measures a temperature of a surface of the soft layer of the first leaf and the second temperature sensor measures one of the group comprising ambient temperature, a temperature of the heating element of the second leaf, and a temperature of a user of the seat warming device.

In some embodiments, the control unit wirelessly receives a desired temperature from a remote control, and the control unit adjusts the temperature of the heating element based on the desired temperature.

In some embodiments, the two or more leaves are configured to connect to the control unit with a connection cable connected to the control unit, the connection cable splitting into at least two leaf cables, with each of the two or more leaves connected to one of the at least two leaf cables, wherein the connection cable is configured to extend and shorten and each of the at least two leaf cables are configured to extend and shorten.

In some embodiments, a remote control configured to wirelessly send a desired temperature to the control unit; wherein the control unit adjusts the temperature of the heating element based on one or more signals from a group of signals comprising a temperature signal from the first temperature sensor, the bio-signal, and the desired temperature.

In some embodiments, the control unit includes buttons or other input interfaces to enable control of the device and a display to show one or more states, status, or parameters of the device. In some embodiments, the control unit includes a computing device including a processor, memory, and an input/output module. In some embodiments, the control unit includes software to operate the seat warming device. In some embodiments, the control unit includes a software or hardware finite state machine to operate the seat warming device. The input/output module may operate wired, wirelessly, or both wired and wirelessly connected to the other components, heating elements, sensors, and parts of the seat warming device. The control unit is within an enclosed housing. In some embodiments, the input/output module is configured to directly drive heating elements. In some embodiments, the input/output module connects with drivers that drive heating elements.

In various embodiments, a method of operation of a seat warming device includes determining whether the device is in manual or automatic operation, determining whether the device is activated when in manual mode or determining whether pressure is detected when in automatic mode, reading the sensors, determining whether a bio-sensor threshold was crossed, determining whether to trigger an alarm based on the sensor readings, and determining whether to start or to stop driving heating elements based on sensor readings.

Additional features and advantages of the embodiments disclosed herein will be set forth in the detailed description that follows, and in part will be clear to those skilled in the art from that description or recognized by practicing the embodiments described herein, including the detailed description which follows, the claims, as well as the appended drawings.

Both the foregoing general description and the following detailed description present embodiments intended to provide an overview or framework for understanding the nature and character of the embodiments disclosed herein. The accompanying drawings are included to provide further understanding and are incorporated into and constitute a part of this specification. The drawings illustrate various embodiments of the disclosure, and together with the description explain the principles and operations thereof. Other devices, features, and advantages of the disclosure will be, or will become, apparent to one with skill in the art upon examination of the following figures and detailed description. It is intended that all such additional devices, features, and advantages be included within this description, be within the scope of the disclosure, and be protected by the following claims.

BRIEF DESCRIPTION OF THE DRAWINGS

The features and advantages of the present disclosure will be more full described in, or rendered obvious by the following detailed description of the preferred embodiments, which are to be considered together with the accompanying drawings wherein like numbers refer to like parts and further, wherein:

FIG. 1A top view of a seat warming device, in accordance with some embodiments described herein;

DETAILED DESCRIPTION

Figure 1A:
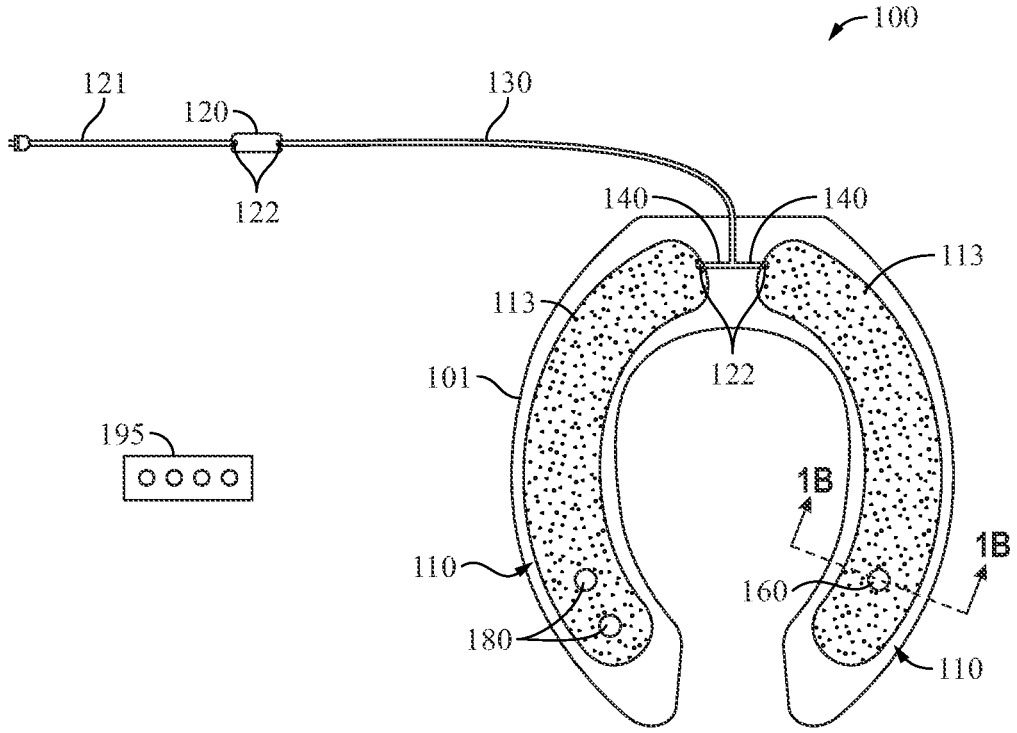

Reference will now be made in detail to the present preferred embodiment(s), and examples of which is/are illustrated in the accompanying drawings. Whenever possible, the same reference numerals will be used throughout the drawings to refer to the same or like parts.

In various embodiments, as shown in FIGS. 1-5, a seat warming device suitable for toilet seats and method of operation is provided. FIG. 1A shows a seat warming device 100 on an environment toilet seat 101. FIG. 1A shows the seat warming device 100 includes two or more leaves 110, a control unit 120, and a remote control 195. In some embodiments, the seat warming device 100 includes only one leaf 110 or at least one leaf 110. FIG. 1A shows the two or more leaves 110 have texture 113. In some embodiments, some or none of the two or more leaves 110 have texture 113. The texture 113 is a series of singular or point depressions and/or protrusions scattered on the top surface of the two or more leaves 110. The texture 113 can provide comfort to a user sitting on or touching such texture 113. The texture 113 can change the degree and manner of heat transfer and heat sensation between the two or more leaves 110 and a user. In some embodiments, the texture 113 is horizontal line, vertical line, diagonal line, circle, figure, geometrical, and/or point depressions and/or protrusions.

FIG. 1A shows a first leaf of the two or more leaves 110 includes a temperature sensor 160 and a second leaf of the two or more leaves 110 includes biosensors 180. The biosensors 180 may be galvanic skin response or skin conductance sensors, heart rate sensors, ECG (electrocardiogram) sensors, haptic sensors, acoustic wave biosensors, ultrasonic sensors, optical biosensors, skin pH sensor, electrochemical biosensors, magnetoelectric biosensors, piezoelectric biosensors, and/or the like. In various embodiments, at least one of the two or more leaves 110 includes one or more temperature sensors 160. In various embodiments, at least one of the two or more leaves 110 includes one or more biosensors 180. In various embodiments, at least one of the two or more leaves 110 includes one or more temperature sensors 160 and/or one or more biosensors 180.

FIG. 1A shows the control unit 120 is configured to be connected to an electrical outlet through a power cable 121. In some embodiments, the control unit 120 is configured to be connected or operate with one or more power sources, such as batteries, electrical outlets, solar power, photovoltaic cells, and/or the like. In some embodiments, the control unit 120 is integrated with the two or more leaves 110 or with one of the two or more leaves 110. In some embodiments with one leaf 110, the control unit 120 is integrated with the one leaf 110. In some embodiments with one or more leaves 110, the control unit 120 is integrated with the one or more leaves 110. In some embodiments, the control unit 120 is integrated with the remote control 195. The control unit 120 has a first retractable cable mechanism 122 connected to the power cable 121 and a second retractable cable mechanism 122 connected to adjustable connection cable 130. Each of the two or more leaves 110 has a retractable cable mechanism 122 connected to respective leaf cable 140. In some embodiments, there is no separate control unit 120, in such a way that the features, functionality, and characteristics of the control unit 120 are integrated in any of the two or more leaves 110.

The remote control 195 is configured to communicate wirelessly with the control unit 120. The remote control 195 send information and/or data, including an activation and deactivation signal to turn on or off the seat warming device 100, a desired temperature of a user, the desired temperatures of multiple users, a user profile and/or preferences, and/or modes of operation including manual mode or automatic mode. In manual mode, a user starts or stops the operation of the seat warming device 100. In automatic mode, the seat warming device 100 uses sensors, such as temperature sensors 160, pressure sensors 170 biosensors 180, further discussed below in FIG. 1B.

Figure 1B:
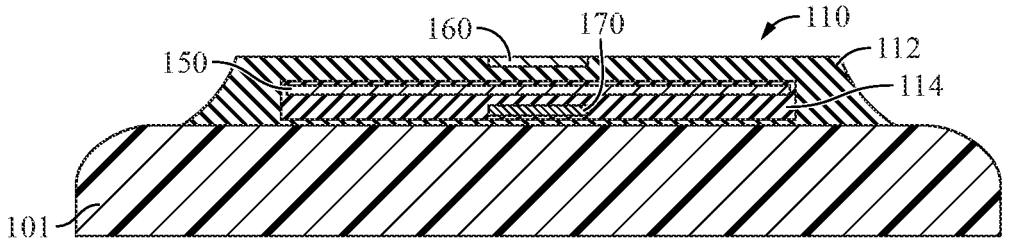
FIG. 1B is a cross-section of a seat warming device in FIG. 1A, in accordance with some embodiments described herein.

FIG. 1B shows a cross-section of FIG. 1A. FIG. 1B shows that a leaf of the two or more leaves 110 has a soft layer 112 and a compressible layer 114. The soft layer 112 surrounds the compressible layer 114. FIG. 1B shows the temperature sensor 160 embedded in the soft layer 112 and the heating element 150 and the pressure sensor 170 embedded in the compressible layer 114. The soft layer 112 and the compressible layer 114 are made with polydimethylsiloxane (PDMS). In the manufacturing process, the compressible layer 114 is manufactured to have the heating element 150 and the pressure sensor 170 embedded in the compressible layer 114. The soft layer 112 surrounds the compressible layer 114. Once the compressible layer 114 is manufactured, the soft layer 112 is manufactured around the compressible layer 114 and embedded with the temperature sensor 160. In various embodiments, soft layer 112 is made of foam, silicon, rubber, resin, polyresin, PDMS, or any other soft and/or cushioning material amenable to sitting and direct skin contact. In various embodiments, compressible layer 114 is made of foam, silicon, rubber, resin, polyresin, polydimethylsiloxane (PDMS), or any other soft and/or cushioning material amenable to sitting and direct skin contact. In some embodiments, the soft layer 112 is anti-microbial. In some embodiments, the surface of the soft layer 112 is anti-microbial. In some embodiments, the upper portion of the surface of the soft layer 112 is anti-microbial. In various embodiments the heating element 150, the temperature sensor 160, and/or the pressure sensor 170 are embedded in different layers of any leaf of the two or more leaves 310 than those shown in FIG. 3B. For example, for a particular leaf 110, the heating element 150 might be embedded in the soft layer 112, while the temperature sensor 160 might be embedded in the compressible layer 114.

Note that the positioning of a temperature sensor 160 affects the temperature reading. A temperature sensor 160 that in operation is in contact with skin will obtain skin temperature readings but will not appropriately obtain ambient temperature readings, while a temperature sensor 160 embedded next to a heating element 150 will not obtain appropriate ambient temperature readings but will obtain the temperature of the heating element 150. Thus, multiple temperature sensors 160 might be located in different positions of different leaves 110 and be configured to measure ambient temperature, a temperature of a surface of a leaf 110, a temperature of the heating element 150, a temperature of any layer of a leaf 110, and/or a temperature of a user of the seat warming device.

FIG. 1B shows the bottom surface of the soft layer 112 rests, in operation, on the surface of environment toilet seat 101. The soft layer 112 is configured to provoke friction between the bottom surface of the soft layer 112 and the surface of environment toilet seat 101, such that the two or more leaves 110, as shown in FIG. 1A, will not slide in operation, while maintaining the capacity to be removed by pulling or peeling the two or more leaves 110 off from the environment toilet seat 101. In some embodiments, the bottom surface of the soft layer 112 has glue, a permanent adhesive, a non-permanent adhesive, a friction provoking configuration, double sided tape, Velcro®, suction, one or more suction cups, and/or the like.

In some embodiments, each of the two or more leaves 110 includes one or more heating elements 150 in the soft layer 112 and/or the compressible layer 114. In some embodiments, the heating element 150 is a resistive heating element that expands through the length of each of the two or more leaves 110, such as a cable, a flexible cable, a film, a flexible film, a strip, a flexible strip, and/or the like. In some embodiments, the heating element 150 is a chemical heating element that expands through the length of each of the two or more leaves 110. In various embodiments, each of the two or more leaves 110 has multiple heating elements 150 in one or more layers of each of the two or more leaves 110. In some embodiments, the heating element 150 is configured to adjust to a temperature within a range of temperatures while in operation.

Figure 1C:
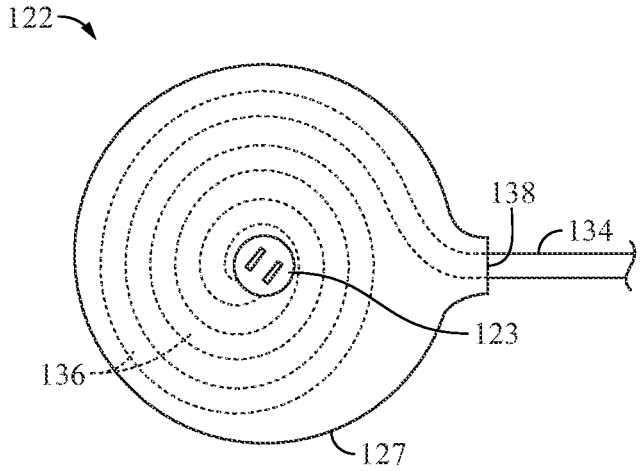
FIG. 1C is a top view of a retractable cable mechanism of the seat warming device in FIG. 1A, in accordance with some embodiments described herein.

Referring back to FIG. 1A, the control unit 120 has at least two retractable cable mechanisms 122 and each of the two or more leaves 110 has at least one retractable cable mechanism 122. In various embodiments, the control unit 120 has one or more retractable cable mechanisms 122. FIG. 1A shows an adjustable connector cable 130 coming out of the retractable cable mechanism 122 of the control unit 120. The adjustable connection cable 130 splits into two or more leaf cables 140, each leaf cable 140 connecting to one of the retractable cable mechanisms 122 of each of the two or more leaves 110. The adjustable connection cable 130 and/or the two or more leaf cables 140 are configured to change length by shortening or extending. FIGS. 1A and 1C show the adjustable connection cable 130 and/or the two or more leaf cables 140 are configured to change in length through the retractable cable mechanism 122.

FIG. 1C shows the retractable cable mechanism 122 in more detail. The retractable cable mechanism 122 allows a cable 134, such as the adjustable connection cable 130 and/or the two or more leaf cables 140, to be pulled from the retractable cable mechanism 122, thus extending the length of cable 134, and also allows a cable to be retracted into a coiled cable 136 inside a mechanism housing 127, thus shortening the cable length. In operation, the retractable cable mechanism 122 lets a user pull a cable 134 to extend the length of the cable 134, and allows a user initially pull the cable 134 and subsequently let go the cable 134 with no tension or no pulling to shorten the length of the cable 134. The cable 134 goes inside the retractable cable mechanism 122 through an opening 138 in the housing 127 and coils inside into the coiled cable 136. A springing apparatus 123 either places pulling tension on cable 134 or locks in place and loosens the pulling tension on cable 134 through rotational tension (or lack thereof) on the coiled cable 136. Referring back to FIG. 1A, in some embodiments, the adjustable connection cable 130 and/or the two or more leaf cables 140 are configured to change in length by replacing the adjustable connection cable 130 and/or the two or more leaf cables 140 with versions of the adjustable connection cable 130 and/or the two or more leaf cables 140 that have different lengths. In some embodiments, the adjustable connection cable 130 and/or the two or more leaf cables 140 change in length by a user pulling and/or releasing the adjustable connection cable 130 and/or the two or more leaf cables 140, such as with coiled cables, retractable cables, retractable coiled cables, springing cables, extendable cables, and/or the like. In some embodiments, the adjustable connection cable 130 and/or the two or more leaf cables 140 are configured to change in length by connecting and/or disconnecting portions of the adjustable connection cable 130 and/or the two or more leaf cables 140, adding additional pieces of cable to increase the length or removing pieces of cable decrease length.

Figure 2:
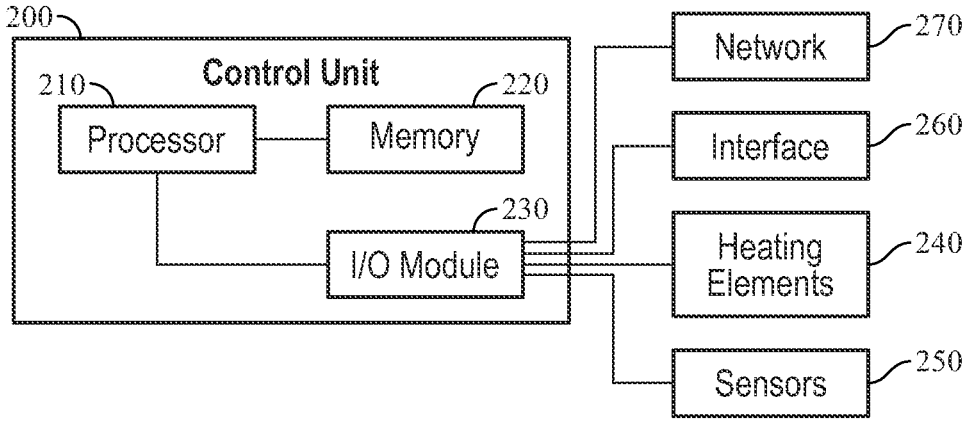
FIG. 2 is a block diagram of a control unit of a seat warming device, in accordance with some embodiments described herein.

FIG. 2 is a conceptual block diagram of a control unit 200, according to one embodiment. Various features described within FIG. 2 may generally complement the description of the other figures of the present disclosure. The control unit 200 may be substantially similar to and generally complement the description of the control unit 120 of FIG. 1A. The control unit 200 may be substantially similar to generally complement the description of the control unit 120 of FIG. 3A and the control unit 420 of FIG. 4, described below. The control unit 200 is configured to implement at least one aspect of the present disclosure described herein. The control unit 200 may be any type of finite state machine or any type of device capable of executing application programs including, without limitation, instructions associated with a input/output module 210, heating elements 240 and sensors 250, an interface 260, and/or a network 270. The control unit 200 includes a processor(s) 210, a memory 220, and an input/output module (or I/O module) 230. The control unit 200 includes a dedicated computing device, a desktop computer, a laptop computer, a smart phone, a personal digital assistant (PDA), tablet computer, or any other type of computing device configured to receive input, process data, and optionally display images, and is suitable for practicing one or more embodiments. The control unit 200 described herein is illustrative and any other technically feasible configurations fall within the scope of the present disclosure.

Processors 210 includes any suitable processor implemented as a central processing unit (CPU), a graphics processing unit (GPU), an application-specific integrated circuit (ASIC), a field programmable gate array (FPGA), an artificial intelligence (AI) accelerator, any other type of processing unit, or a combination of different processing units, such as a CPU configured to operate in conjunction with a GPU. In general, processors 210 may be any technically feasible hardware unit capable of processing data and/or executing software applications. Further, in the context of this disclosure, the computing elements shown in control unit 200 may correspond to a physical computing system (e.g., a local or networked computing device) or may be a virtual computing instance executing within a computing cloud.

Memory 220 includes a random-access memory (RAM) module, a flash memory unit, or any other type of memory unit or combination thereof. Processors 210 and I/O module 230 are configured to read data from and write data to memory 220. Memory 220 includes various software programs that can be executed by processor(s) 210 and application data associated with said software programs, including software that runs methods, steps, and processes such as the software, methods, steps, and/or processes described in this disclosure, including those described for FIG. 5 below.

I/O module 230 provides the hardware, firmware, and/or software for the control unit 200 to interact with other components and devices, including heating elements 240 and sensors 250, the interface 260, the network 270, and/or the like.

The control unit 200, through the I/O module 230, drives one or more heating elements 240 by sending a voltage, current, and/or signal that changes or adjusts the heat caused by heating elements 240. The heating elements 240 may be substantially similar to and generally complement the description of the heating element 150 of FIGS. 1B and 3B.

The control unit 200, through the I/O module 230, actuates, sends, and/or receives signals and/or data from sensors 250 and/or interface 260. The sensors 250 may be substantially similar to and generally complement the description of the temperature sensors 160 of FIGS. 1A, 1B, 3A, 3B, and 4 and/or of the biosensors 180 of FIGS. 1A, 3A, and 4, and/or of the pressure sensors 170 of FIGS. 1B and 3B. In some embodiments, the control unit 200 actuates, sends, and/or receives activation signals and/or bio-signals from sensors 250 such activation signals from pressure sensors and/or bio-signals from biosensors. Interface 260 includes devices capable of providing input, such as a keyboard, a mouse, a touch-sensitive screen, and so forth, as well as devices capable of providing output, such as a display device. Additionally, interface 260 may include devices capable of both receiving input and providing output, such as a touchscreen, a universal serial bus (USB) port, and so forth. Interface 260 may be configured to receive various types of input from an user of a warming device (such as seat warming devices 100, 300, or 400), and to also provide various types of output to the user, such as displayed digital images or digital videos or text. In some embodiments, interface 260 is embedded and/or integrated with the control unit 200. For example, the control unit 200 may have the interface 260 on the housing that encloses the control unit 200.

The network 270 includes any technically feasible type of communications network that allows data to be exchanged between the control unit 200 and external entities or devices, such as a web server or another networked computing device. For example, network 110 may include a wide area network (WAN), a local area network (LAN), a wireless (WiFi) network, Bluetooth®, and/or the Internet, among others. In some embodiments, the I/O module 230 is not directly connected to one or more of the heating elements 240, the sensors 250, and/or the interface 270. In such embodiments the I/O module 230 connects wirelessly to the heating elements 240, the sensors 250, and/or the interface 270 through the network 270.

FIG. 3 shows a seat warming device 300 on an environment toilet seat 101. In various embodiments, the seat warming device 300 incorporates the features and characteristics of the seat warming device 100 of FIG. 1. In various embodiments, the seat warming device 300 includes a control unit 320, which incorporates the features and characteristics of the control unit 120 of FIG. 1 and/or the control unit 200. In various embodiments, the seat warming device 300 includes two or more leaves 310, which incorporate the features and characteristics of the two or more leaves 110 of FIG. 1.

Figure 3A:
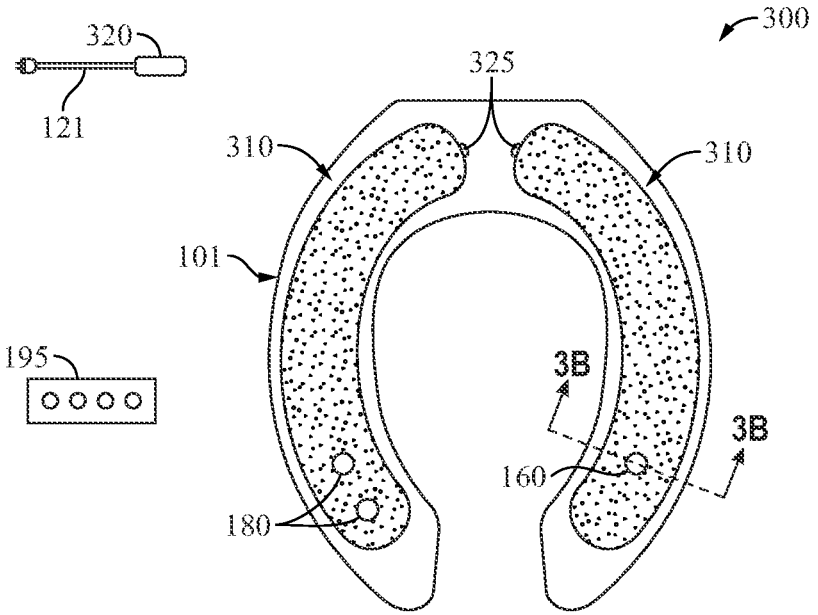
FIG. 3A is a top view of a seat warming device, in accordance with some embodiments described herein.

FIG. 3A shows that control unit 320 is connected to a power cable 121 but is not physically connected to the two or more leaves 310. Control unit 320 communicates with the components of the two or more leaves 310 (the temperature sensor 160, the biosensors 180 and/or the pressure sensor 170 of FIGS. 3A and 3B) wirelessly through a network, such as the network 270 of FIG. 2, To enable communication through a network, such as the network 270 of FIG. 2, the two or more leaves 310 include an 110 unit 325. The I/O unit 325 connects, drives, actuates, sends and/or receives signals and/or data from the temperature sensor 160, the biosensors 180 and/or the pressure sensor 170 of FIGS. 3A and 3B in a similar fashion and/or with the same features and characteristics of the I/O module 230 of FIG. 2. In some embodiments, there is no separate control unit 320 and power cable 121 in such a way that the features, functionality, and characteristics of the control unit 320 are integrated in any of the two or more leaves 310, making seat warming device 300 completely wireless.

FIG. 3A shows the remote control 195 is configured to communicate wirelessly with the control unit 320. The remote control 195 send information and/or data, including an activation and deactivation signal to turn on or off the seat warming device 300, a desired temperature of a user, the desired temperatures of multiple users, a user profile and/or preferences, and/or modes of operation including manual mode or automatic mode. In manual mode, a user starts or stops the operation of the seat warming device 100. In automatic mode, the seat warming device 300 uses sensors, such as temperature sensors 160, pressure sensors 170, biosensors 180, further discussed below in FIG. 3B. In embodiments that are completely wireless (i.e., with the control unit 320 completely integrated into the two or more leaves 310, as discussed above), remote control 195 communicates with the two or more leaves 310.

Figure 3B:
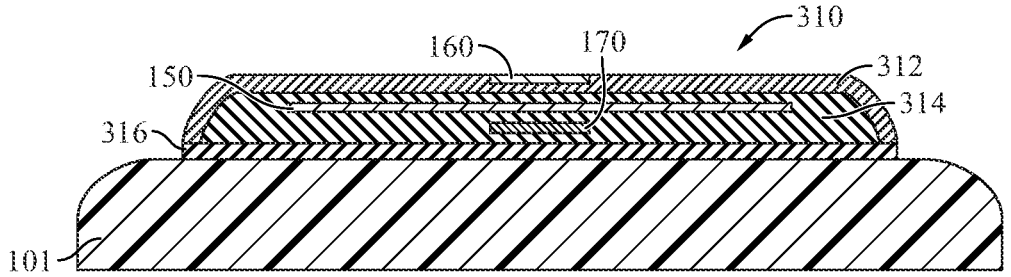
FIG. 3B is a cross-section of a seat warming device in FIG. 3A, in accordance with some embodiments described herein.

FIG. 3B show a cross-section of a leaf of the two or more leaves 310 on an environment toilet seat 101. The leaf of the two or more leaves 310 shown has three layers. At the bottom is a substrate layer 316. Above the substrate layer 316 are a soft layer 312 and a compressible layer 314. The compressible layer 314 is under the soft layer 312. The soft layer 312 falls on each side of the compressible layer 314, such that the compressible layer 314 is completely enclosed between the soft layer 312 and the substrate layer 316. In some embodiments, the compressible layer 314 is not fully enclosed.

FIG. 3B shows the temperature sensor 160 embedded in the soft layer 312 and the heating element 150 and the pressure sensor 170 are embedded in the compressible layer 314. The soft layer 312, the compressible layer 314, and the substrate layer 316 are made with polydimethylsiloxane (PDMS). In some embodiments, the soft layer 312, the compressible layer 314, and the substrate layer 316 are made with different materials, in a similar fashion and/or with the same features and characteristics of the soft layer 112 and/or the compressible layer 114 of FIG. 1B. In various embodiments, the heating element 150, the temperature sensor 160, and/or the pressure sensor 170 are embedded in different layers of any leaf of the two or more leaves 310 than those shown in FIG. 3B.

FIG. 3B shows the bottom surface of the substrate layer 316 rests, in operation, on the surface of environment toilet seat 101. The substrate layer 316 is configured to provoke friction between the bottom surface of the substrate layer 316 and the surface of environment toilet seat 101, such that the two or more leaves 310, as shown in FIG. 3A, will not slide in operation, while maintaining the capacity to be removed by pulling or peeling the two or more leaves 310 off from the environment toilet seat 101. In some embodiments, the bottom surface of the substrate layer 316 has glue, a permanent adhesive, a non-permanent adhesive, a friction provoking configuration, double sided tape, Velcro®, suction, one or more suction cups, and/or the like.

Figure 4:
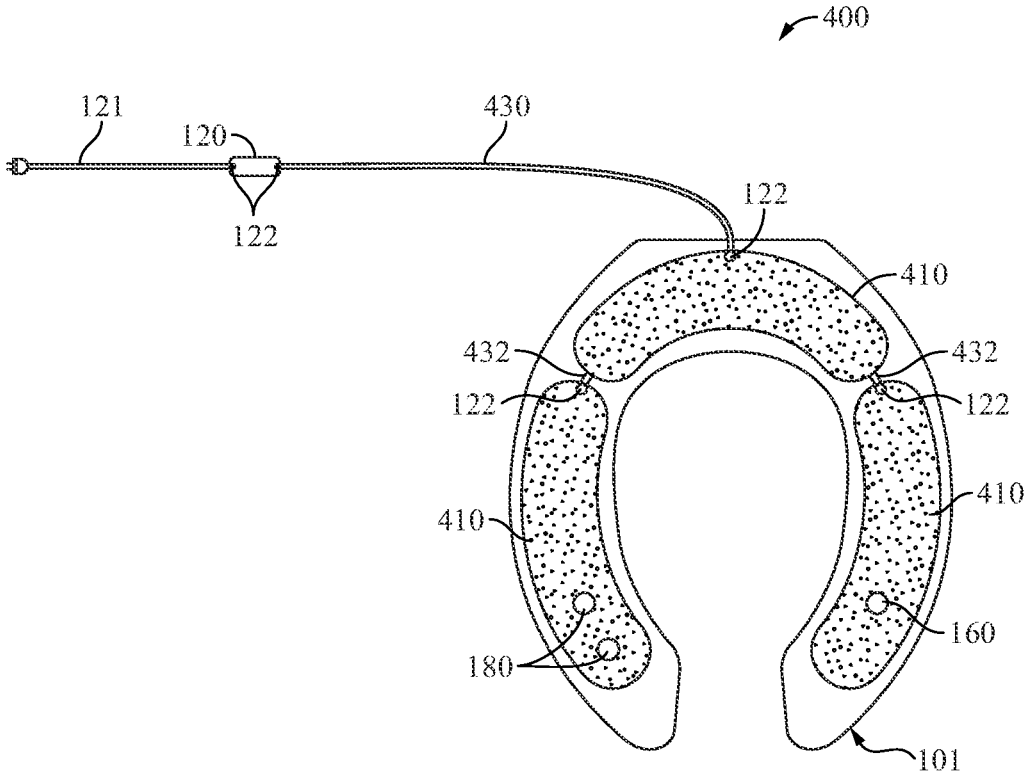
FIG. 4 is a top view of a seat warming device, in accordance with some embodiments described herein.

FIG. 4 shows a seat warming device 400 on an environment toilet seat 101. In various embodiments, the seat warming device 400 incorporates the features and characteristics of the seat warming device 100 of FIG. 1 and the seat warming device 300 of FIG. 3. In various embodiments, the seat warming device 400 includes a control unit 120, which incorporates the features and characteristics of the control unit 200 of FIG. 2. In various embodiments, the seat warming device 400 includes three or more leaves 410, which incorporate the features and characteristics of the two or more leaves 110 of FIG. 1 and/or the two or more leaves 310 of FIG. 3. At least one of the three or more leaves 410 has one or more heating elements and/or one or more pressure sensors (not shown). The seat warming device 400 does not have a remote control. The seat warming device 400 is controlled through an interface of the control unit 120, such as interface 260 of FIG. 2. In some embodiments, the seat warming device 400 includes a remote control. In some embodiments, a remote control is included with the seat warming device 400, and such remote control includes an interface such as interface 260 of 2.

FIG. 4 shows the control unit 120 has a first retractable cable mechanism 122 connected to the power cable 121 and a second retractable cable mechanism 122 connected to adjustable connection cable 430. FIG. 4 shows the seat warming device 400 has at least three leaves 410. A first leaf 410 has a retractable cable mechanism 122 connected to adjustable connection cable 430. The first leaf 410 connects to a second leaf 410 with a first leaf cable 432 and to a third leaf 410 with a second leaf cable 432. The second leaf 410 has two biosensors 180. The third leaf 410 has a temperature sensor 160. Each of the second leaf 410 and the third leaf 410 have a third and a fourth retractable cable mechanism 122, respectively. The first leaf cable 432 connects to the second leaf 410 through the third retractable cable mechanism 122. The second leaf cable 432 connects to the third leaf 410 through the fourth retractable cable mechanism 122, Example Process To enable the reader to obtain a clear understanding of the technological concepts described herein, the following process describes specific steps performed in a specific order. However, one or more of the steps of a particular process may be rearranged and/or omitted while remaining within the contemplated scope of the technology disclosed herein. One or more processes and/or steps thereof, may be combined, recombined, rearranged, omitted, or executed in parallel to create different process flows that are within the contemplated scope of the technology disclosed herein. While the processes below may omit or briefly summarize some of the details of the technologies disclosed herein for clarity, the details described in the paragraphs above may be combined with the process steps described below to get a more complete and comprehensive understanding of these processes and the technologies disclosed herein.

Figure 5:
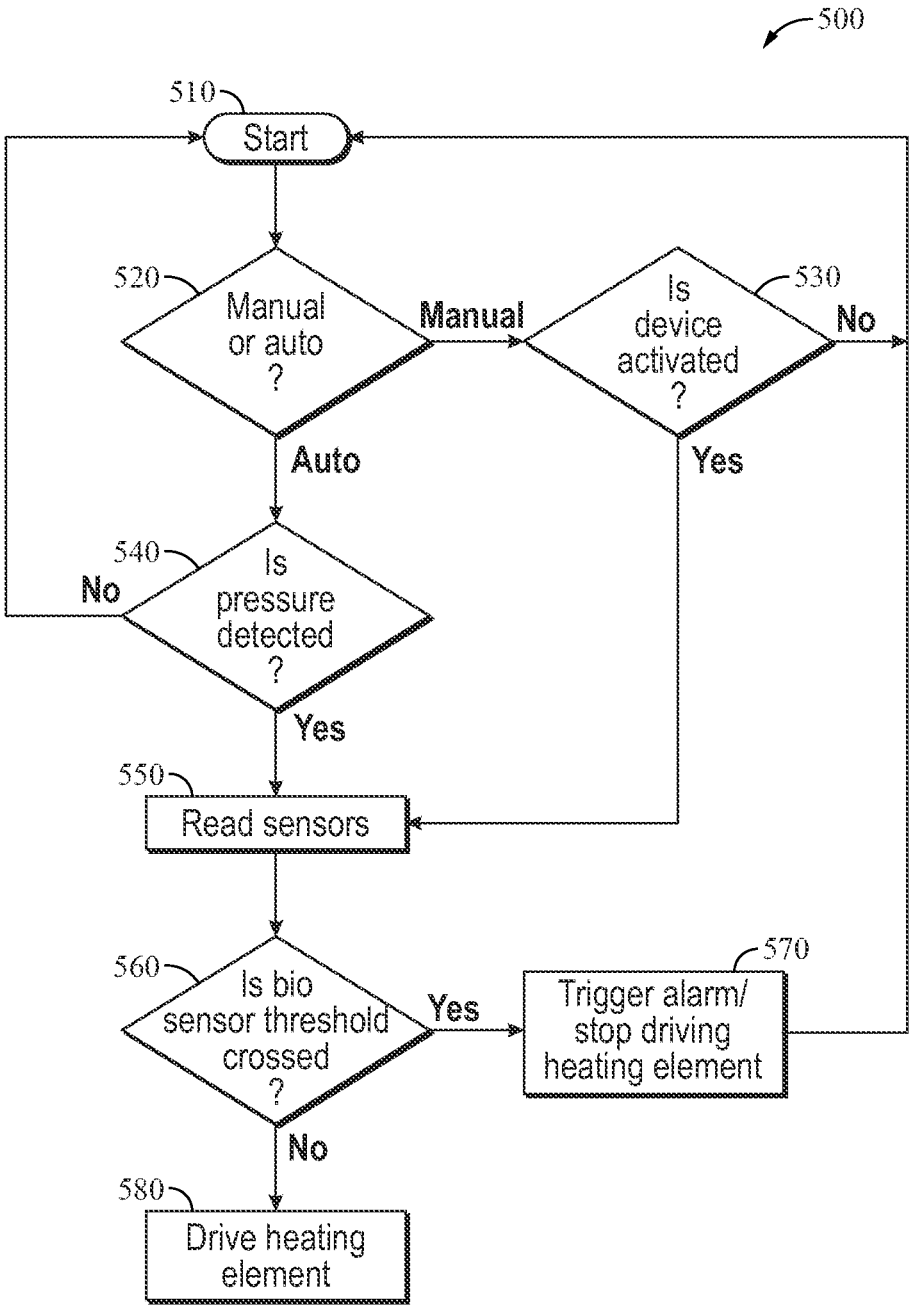
FIG. 5 is a flow diagram illustrating a process of a seat warming device in operation, in accordance with some embodiments described herein.

FIG. 5 is a flow diagram of an example process 500 of the operation of a seat warming device including seat warming devices 100, 300, and 400. In some embodiments, the process 500 begins with step 510, in which the seat warming device is activated or turned on. Next, in step 520, the process 500, generally through a control unit such as control unit 120 or 200, determines whether the device is set in manual mode or automatic mode. If the device is in manual mode, the process 500 moves to step 530 to determine whether the device has been activated for heating. If the device is not activated for heating at step 530, the process 500 goes back to step 510, the beginning of the process 500. If the device is not activated for heating at step 530, the process 500 goes to read sensors at step 550.

If the device is in automatic mode at step 520, the process 500 moves to step 540 to check whether pressure is detected by reading from pressure sensors, such as pressure sensors 170 of FIGS. 1B and 3B. If no pressure is detected at step 540, the process 500 goes back to step 510, the beginning of the process 500. If pressure is detected at step 540, (for example, by the pressure sensors sending an activation signal to the control unit) the process 500 goes to read, sensors at step 550. The purpose of detecting pressure in the automatic mode is that a user will cause pressure by sitting on a seat warming device, while no pressure will be detected when nobody is sitting or touching the device. In some embodiments, the process 500 at step 540 determines whether a threshold pressure has been met based on a pressure signal from a pressure sensor. Thus, if a user sits on the device, the process 500 will detect pressure and move on to the next step in the process 500 by sending an activation signal to the control unit, but if partial pressure or a signal fluctuation presents pressure that does not meet the threshold, no activation signal is sent to the control unit. In some embodiments, the activation signal is a pressure signal from a pressure sensor that meets and/or crosses the pressure threshold. In some embodiments, instead of or in addition to pressure, other sensors and signals are used. For example, step 540 may determine whether a biosensor, such as biosensor 180 of FIGS. 1A, 3A, and 4, detects skin or a heart rate indicating that a user is sitting on or touching the device. Aa another example, step 540 may combine the input of a pressure sensor (detecting a user or something is sitting on the device) with a biosensor input of skin conductance and/or heart rate (detecting a user) versus the lack of a biosensor input (the lack of skin conductance and/or heart rate detection) indicating that something other than a user is in contact with the device, or in the context of a toilet seat, that a user might be sitting with their clothes on while on the device.

In step 550, the process 500 requests, receives, and/or reads data and/or signals from the sensors, such as temperature sensors 160, pressure sensors 170, biosensors 180 and sensors 250 of FIGS, and moves on to step 560. 1-4. In some embodiments, step 550 includes requesting, receiving, and/or reading a desired temperature of a user, the desired temperatures of multiple users, and/or a user profile and/or preferences.

In step 560 the compares bio-signals received from sensors to a predetermined, calculated, or user provided threshold. In some embodiments, at step 560 the process 500 determines whether a heart rate and/or whether an ECG signal and/or whether skin conductance indicates that the user is distress based on a predetermined, calculated, or user provided threshold. In some embodiments, the process 500 at step 560 checks whether the current temperature detected at step 550 is above or below a desired or target temperature. In some embodiments, the process 500 at step 560 determines whether the current operation of the device satisfies the desired temperature and/or preferences of a particular user in view of the user profile and/or preferences.

Note that different leaves, such as leaves 110, 310, and 410, may be at different temperatures due to differences in ambient temperature, manufacturing quality affecting rate of change in temperature of the heating elements and/or the leaves, and/or the like. Thus, the same process 500 may determine that a particular leaf (or parts of particular leaves) should be driven to increase heat while another leaf should not be driven, or that different leaves should be driven at different rates to cause different graduations in the rate of change of heat for each leaf.

If there is no distress and the target temperature has not been reached, the process 500 moves to step 580 to start driving the heating elements (or continue driving the heating elements). In some embodiments, after the process 500 reaches step 580, the process 500 goes back to step 510. If there is distress and/or the target temperature has been reached, the process 500 moves to step 570.

In step 570, the process 500 triggers an alarm and/or stops driving the heating elements. In some embodiments, the alarm is a sound and/or visual alarm, text messages, an alert to first responders, and/or the like. After step 570, the process 500 goes back to step 510.

The foregoing is provided for purposes of illustrating, explaining, and describing embodiments of this disclosure. Modifications and adaptations to these embodiments will be apparent to those skilled in the art and may be made without departing from the scope or spirit of this disclosure.

Although the subject matter has been described in terms of exemplary embodiments, it is not limited thereto. Rather, the appended claims should be construed broadly, to include other variants and embodiments, which may be made by those skilled in the art.

I claim:

1. A removable toilet seat warming device, comprising:

two or more leaves connected to a control unit;

a first temperature sensor embedded in a first leaf of the two or more leaves, wherein each of the two or more leaves comprises:

a soft layer that is textured and anti-microbial, a compressible layer under the soft layer, a heating element embedded in the compressible layer, a substrate layer under the compressible layer, the substrate layer comprising an adhesive side capable of bonding to a seat surface or a toilet seat surface, and a pressure sensor configured to send an activation signal to the control unit based on a threshold pressure, wherein at least one of the two or more leaves further comprises a biosensor configured to send a bio-signal to the control unit, and wherein the control unit is configured to activate the heating element based on the activation signal and the bio-signal.

2. The seat warming device of claim 1, wherein the two or more leaves are configured to wirelessly connect to the control unit.

3. The seat warming device of claim 1, wherein the two or more leaves are configured to connect to the control unit with a connection cable connected to the control unit, the connection cable splitting into at least two leaf cables, with each of the two or more leaves connected to one of the at least two leaf cables, wherein the connection cable is configured to change in length and each of the at least two leaf cables is configured to change in length.

4. The seat warming device of claim 3, further comprising a remote control configured to wirelessly send a desired temperature to the control unit; wherein the control unit is configured to adjust the temperature of the heating element based on one or more signals from a group of signals comprising:

a temperature signal from the first temperature sensor, the bio-signal, and the desired temperature.

* * * * *